US008571250B2

(12) United States Patent
Royer et al.

(10) Patent No.: US 8,571,250 B2
(45) Date of Patent: Oct. 29, 2013

(54) DEVICES AND METHODS FOR DAMPENING VIBRATIONS

(75) Inventors: David Royer, Fullertong, CA (US); Richard Perrotta, Burbank, CA (US); Mike Silver, Burbank, CA (US)

(73) Assignee: Royer Labs, Burbank, CA (US)

( * ) Notice: Subject to any disclaimer, the term of this patent is extended or adjusted under 35 U.S.C. 154(b) by 49 days.

(21) Appl. No.: 13/332,779

(22) Filed: Dec. 21, 2011

(65) Prior Publication Data

US 2013/0004010 A1 Jan. 3, 2013

Related U.S. Application Data

(60) Provisional application No. 61/571,530, filed on Jun. 30, 2011.

(51) Int. Cl.
*H04R 21/02* (2006.01)

(52) U.S. Cl.
USPC ..... 381/368; 381/361; 381/362

(58) Field of Classification Search
USPC ..... 381/368, 361, 362
See application file for complete search history.

(56) References Cited

U.S. PATENT DOCUMENTS

| | | | | |
|---|---|---|---|---|
| 1,805,362 | A | 5/1931 | Ellis | |
| 2,920,150 | A | 1/1960 | Burroughs | |
| 4,194,096 | A | 3/1980 | Ramsey | |
| 4,396,807 | A | 8/1983 | Brewer | |
| 4,514,598 | A | 4/1985 | Plice | |
| 4,546,950 | A | 10/1985 | Cech | |
| 5,827,155 | A * | 10/1998 | Jensen et al. | 482/54 |
| 6,459,802 | B1 | 10/2002 | Young | |
| 6,724,904 | B1 | 4/2004 | Winter | |
| 8,218,807 | B1 * | 7/2012 | Johnson | 381/361 |
| 2007/0195983 | A1 | 8/2007 | Klemme | |
| 2009/0279730 | A1 * | 11/2009 | Sank | 381/368 |
| 2010/0239113 | A1 * | 9/2010 | Browne | 381/361 |

FOREIGN PATENT DOCUMENTS

| | | |
|---|---|---|
| JP | 2002204491 | 7/2002 |

* cited by examiner

*Primary Examiner* — Curtis Kuntz
*Assistant Examiner* — David J Ho
(74) *Attorney, Agent, or Firm* — Roland J. Tong; Brooks Kushman P.C.

(57) ABSTRACT

A device for isolating a microphone from vibrations, the device comprising a frame comprising a plurality of surfaces, the plurality of surfaces laying on a plane that is different from each other and defining at least one mounting point; at least one non-resonant cord attached to the mounting point of the frame, the non-resonant cord adapted to support a microphone and absorb vibration; and a biasing device connected to the non-resonant cord, the biasing device adapted to provide tension to the non-resonant cord.

18 Claims, 5 Drawing Sheets

DEVICES AND METHODS FOR DAMPENING VIBRATIONS

CROSS REFERENCES TO RELATED APPLICATIONS

This application claims the benefit of U.S. Provisional Application 61/571,530, filed Jun. 30, 2011.

STATEMENT REGARDING FEDERALLY SPONSORED RESEARCH OR DEVELOPMENT

None

FIELD OF INVENTION

This application relates to structures that are configured to hold a microphone and make them detachable, particularly structures that serve as shock absorbing supports and lessen the effects of vibrations.

BACKGROUND

Microphones are designed to pick up sound using a variety of technologies. Along with wanted sounds, microphones also respond to background noise and can pick up interference from vibrations. Certain devices that are sometimes referred to as "shock mounts" have been invented to isolate microphones from vibrations. A shock mount is not to be confused with a microphone clip-type holder which provides virtually none of the acoustic properties of a shock mount.

Shock mounts may be seen in use in recording studios and radio stations, where a very high sound quality is expected. Shock mounts suspend a microphone so that it is less vulnerable to vibrations. Some designs incorporate a cage for the microphone or soft elastic materials, such as rubber elastic bands, woven rubber bungee cords, fluid filled rubber pillows, and rubber bushes to isolate a microphone from the microphone stand or holder. Some designs even utilize metal springs by themselves for isolating the microphone, although these are much less effective because of the metal spring's tendency to transmit vibrations quite easily.

At least one problem with some of the above shock mount designs is that they remain ineffective at decoupling a microphone from a microphone stand allowing low-frequency vibrations and noise to be introduced into the microphone. Another problem with some of the above shock mount designs is that they are prone to deterioration. Current suspension materials wear out, deteriorate or otherwise become less effective over time due to gradual degradation or decomposition of the elastic material used in most designs. For instance, bungee cords lose their elasticity over time and are prone to breaking, which place microphones at risk of being dropped and damaged.

Some of the existing shock mount designs appear to struggle in balancing the ability to support the microphone and the ability to minimize vibrations. Some designs may use too much tension and offer rigid microphone support, but may introduce a substantial amount of vibrations to the microphone. Some designs may cut back on the tension to reduce the vibrations, but may increase the chances of the microphone falling off the microphone stand. Devices or methods for dampening vibrations that do not suffer from the above disadvantages or that improve some of the above deficiencies are desired.

SUMMARY

Accordingly, the present invention includes a device for isolating a microphone from vibrations, the device comprising a frame comprising a plurality of surfaces, the plurality of surfaces laying on a plane that is different from each other and defining at least one mounting point; at least one non-resonant cord attached to the mounting point of the frame, the non-resonant cord adapted to support a microphone and absorb vibration; and a biasing device connected to the non-resonant cord, the biasing device adapted to provide tension to the non-resonant cord.

The present invention also includes a method of dampening vibrations transmitted to a microphone connected to a microphone stand, the method comprising securing the microphone to a microphone mount; providing a cord; providing a frame, the frame comprising a plurality of mounting points; connecting the cord to the microphone mount and a first mounting point of the frame, the cord forming a first line; connecting the cord to the microphone mount and a second mounting point of the frame, the cord forming a second line; and attaching a biasing device to the first and the second line, the biasing device adapted to provide tension to the cord.

The above description sets forth, rather broadly, a summary of embodiments of the present invention so that the detailed description that follows may be better understood and contributions of the present invention to the art may be better appreciated. Some of the embodiments of the present invention may not include all of the features or characteristics listed in the above summary. There may be, of course, other features of the invention that will be described below and may form the subject matter of claims.

DETAILED DESCRIPTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention. Also, it is to be understood that the phraseology and terminology employed herein are for the purpose of description and should not be regarded as limiting.

The present invention provides various embodiments of a vibration dampening device that may be used to isolate a microphone from the vibrations introduced through a microphone holder, as these vibrations may corrupt the microphone's signal. Certain embodiments of the present invention provide superior vibration isolating characteristics while eliminating the use of materials that are prone to wearing out or becoming less effective with time, such as bungee cords and rubber bands. They may serve their intended purpose without much maintenance or deterioration of performance for very long periods of time. The present invention also provides various methods of absorbing or lessening vibrations, such as those that can be transmitted to mounted microphones.

Figure 1:
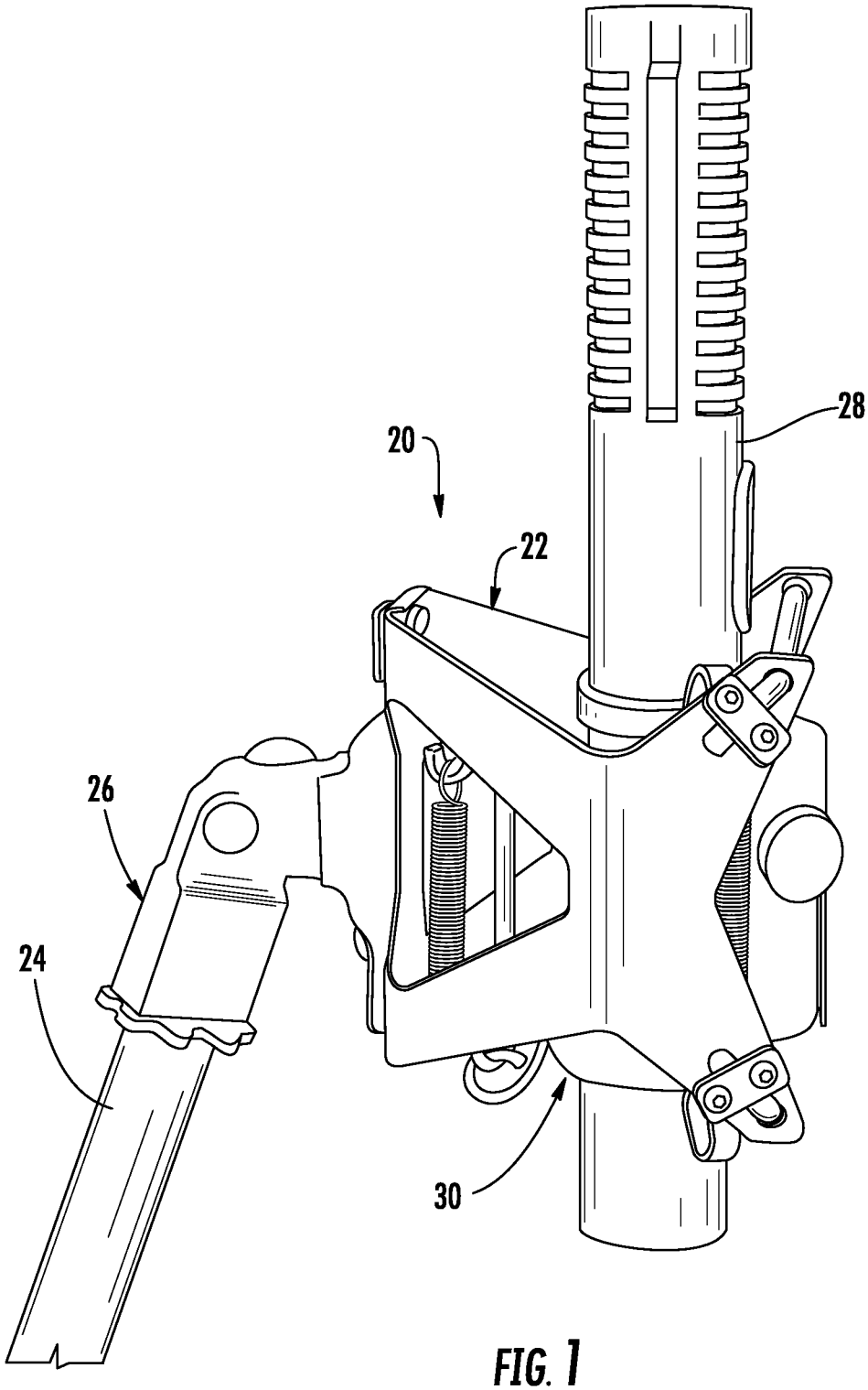
FIG. 1 is substantially a perspective view of an embodiment of a microphone vibration dampening device of the present invention connected to a microphone stand and a microphone.

Referring now to FIG. 1, an embodiment of a vibration dampening device 20 is shown and preferably includes a microphone stand mounting assembly 26 that is configured to attach the vibration dampening device 20 to a microphone stand 24, a suspension assembly 22 that includes various components configured to cooperatively operate to bring about the vibration dampening benefits of the device 20, and microphone clutch assembly 30 configured to adjustably hold a microphone 28.

Figure 2:
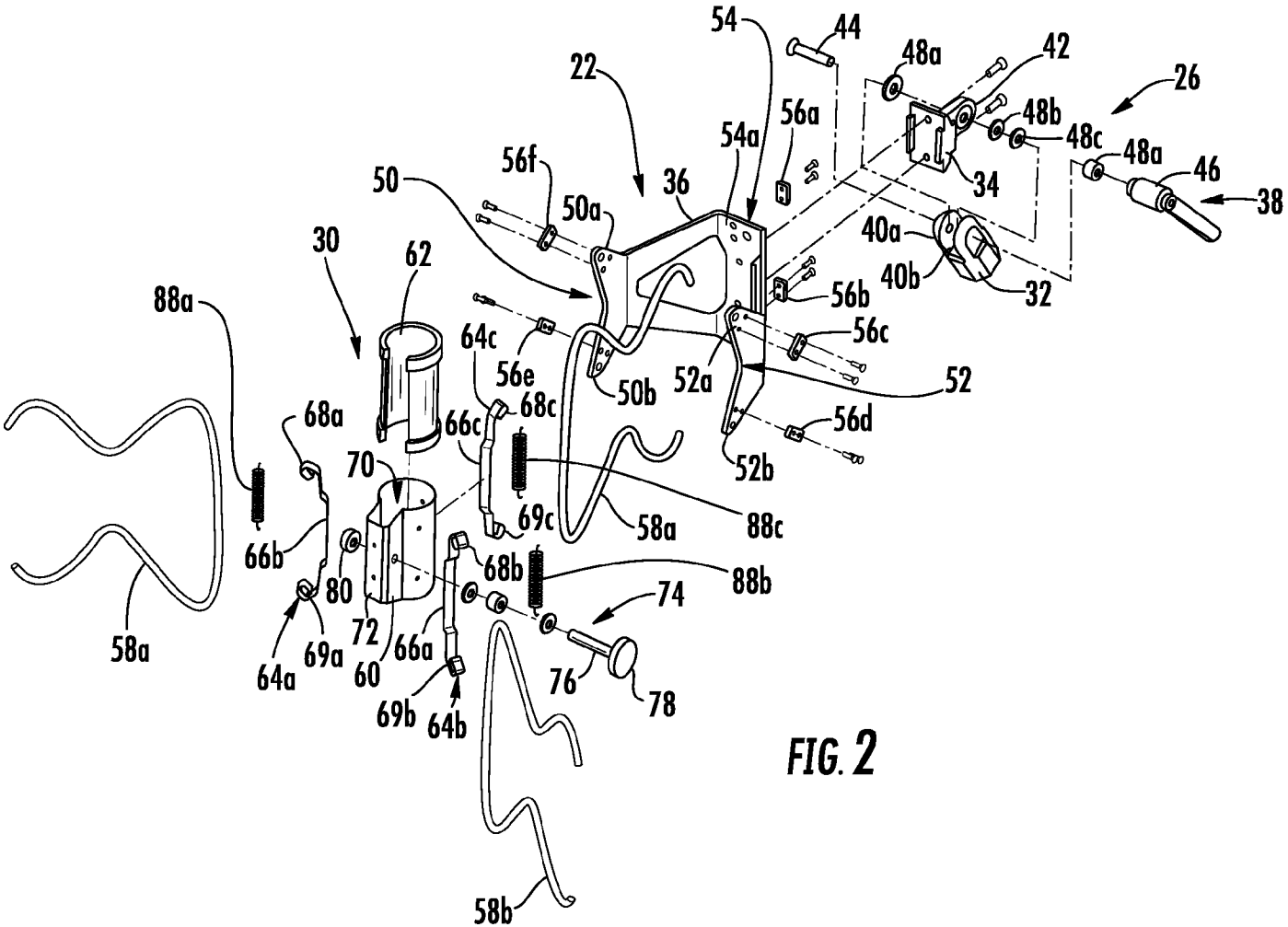
FIG. 2 is substantially an exploded view of the microphone vibration dampening device embodiment of FIG. 1.

Referring now to FIG. 2, the microphone stand mounting assembly 26 preferably includes a microphone stand receiver 32 that may detachably attach to a microphone stand 24, for instance, by allowing the microphone stand 24 to be inserted into a recess (not shown). The microphone stand mounting assembly 26 may further include a suspension assembly mount 34 that may be configured to adjustably hold the suspension assembly 22. The suspension assembly mount 34 may be affixed to the suspension assembly 22, preferably to a frame 36 of the suspension assembly 22 via a plurality of fasteners known in the art. The microphone stand mounting assembly 26 may include an adjustment mechanism 38 to allow the suspension assembly 22 to be moved at various positions relative to the microphone stand 24 thereby also allowing the microphone 28 that is suspended on the suspension assembly 22 to be moved at various positions relative to the microphone stand 24. The adjustment mechanism 38 preferably includes a pair of flanges 40*a* and 40*b* projecting from the microphone stand receiver 32 and a pivot wheel 42 that may be integral to the suspension assembly mount 34. The pivot wheel 42 may be positioned in between the pair of flanges 40*a* and 40*b* and may adjustably be secured via a bolt 44, a plurality of washers 48*a-d*, and a lever nut 46. Of course, various different kinds and combinations of bolts, washers, or nuts may be used and still fall within the scope of the invention. The pivot wheel 42 may or may not have integrated gear teeth to control the movement of the microphone relative to the microphone stand.

With continued reference to FIG. 2, the suspension assembly 22 preferably serves as a foundation and provides mounting points for the suspension components. The frame 36 of the suspension assembly 22 preferably comprises of an enclosing structure adapted to substantially surround the microphone clutch assembly 30. The suspension assembly 22 preferably includes various suspension components, such as vibration dampening cords. 58*a*, 58*b*, and 58*c* adapted to hold the microphone clutch assembly 30 and suspend the microphone 28, as further described below. The enclosing structure of the frame 36 preferably includes various surfaces that may lie on different planes. The enclosing structure of the frame 36 may be a plurality of walls or bars, rings, or tubes (not shown). In the preferred embodiment, the enclosing structure of the frame may further include one open side that does define a surface. The enclosing structure of the frame 36 may, for instance, be a substantially U-shaped structure, a substantially V-shaped structure, or a combination thereof. In the preferred embodiment, the frame 36 is preferably a unibody frame that is built using one piece of metal that is folded according to the design described. Of course, various frame shapes may be utilized and still fall within the spirit of the invention.

The frame 36 preferably provides various sets of mounting points 50*a*, 50*b*, 52*a*, 52*b*, 54*a* and 54*b* for clamps 56*a-f*, which allow for adjustment or tuning of the suspension system. Clamps 56*a-f* are preferably configured to hold their respective vibration dampening cords 58*a*, 58*b*, or 58*c* against portions of the frame 36 and be adjustably attached to the frame 36 by fasteners known in the art. Of course, the number of mounting points, clamps, and vibration dampening cords may be varied and still fall within the scope of the present invention.

Mounting point set 50 of the frame 36 may include mounting points 50*a* and 50*b*, which lie on the same plane. Mounting point set 52 of the frame 36 may include mounting points 52*a* and 52*b*, which lie on the same plane, and is preferably on a different plane from the plane where mounting point set 50 lies. Mounting point set 54 of the frame 36 includes mounting point 54*a* and is preferably on a different plane from the plane where mounting point set 50 and mounting point set 52 lie.

With continued reference to FIG. 2, vibration dampening cords 58*a*, 58*b*, and 58*c* preferably suspend the microphone clutch assembly 30 that is used to hold the microphone. Vibration dampening cords 58*a*, 58*b*, and 58*c* may be made of fiber-woven and cord-like material similar to the material for making round shoelaces. They are preferably non-elastic or non-resonant. They can be made of Nylon, Dacron, cotton or any other material that results in a durable, soft, or non-stretchable "rope" or cord. Unlike an elastic rubber band or bungee cord that tends to become more rigid when flexed or stretched, the vibration dampening cord 58*a*, 58*b*, or 58*c* is less prone to mechanical coupling if suspended loosely and indirectly. A loosely suspended soft cord, such as vibration dampening cord 58*a*, 58*b*, or 58*c*, will not transmit vibrations well. Each of the vibration dampening cords 58*a*, 58*b*, and 58*c* may be coupled with its respective damper 88*a*, 88*b*, and 88*c*, as further described below.

With continued reference to FIG. 2, the microphone clutch assembly 30 preferably includes an adjustable microphone collar 60 and a friction insert 62 to aid in holding the microphone. The friction insert 62 may also be made of materials with vibration dampening characteristics, such as felt or cloth. The adjustable microphone collar 60 preferably includes a microphone area 70, which may be substantially cylindrical and adapted to surround and hold the microphone. The shape of the microphone area 70 may be designed depending on the intended microphone style with which the device will be used. The adjustable microphone collar 60 may further include an adjustment area 72, which may comprise of moveable and overlapping collar pieces (not shown) to allow for the adjustment of The internal diameter of the microphone area 70. The internal diameter of the microphone area 70 may be reduced to tighten the hold on the microphone, or it may be enlarged to loosen the hold on the microphone.

The internal diameter of the microphone area 70 may be made adjustable by a collar adjustment mechanism 74. The collar adjustment mechanism 74 may include a threaded fastener 76 with a knob 78. The threaded fastener 76 may be inserted through the adjustment area 72 and may be secured by a nut 80 on the end of the adjustment area 72 that is opposite to the knob 78. Various washers and fastener components known in the art may be used to supplement or replace certain components of the collar adjustment mechanism 74.

Figure 3:
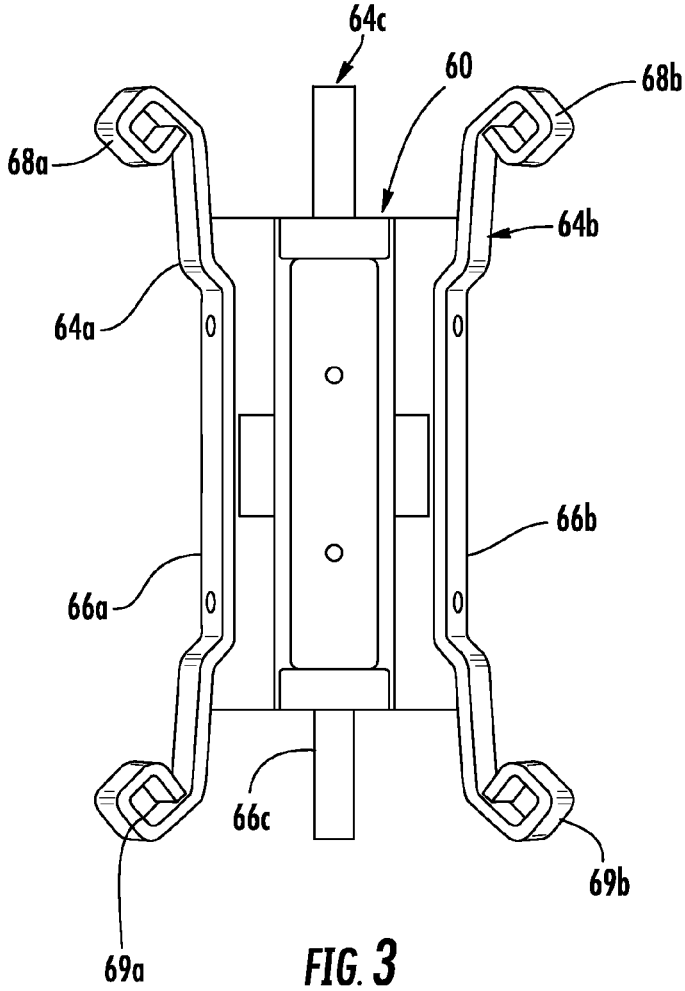
FIG. 3 is substantially a front view of an embodiment of a microphone mount of the present invention.

Referring now to FIG. 3, the microphone collar 60 may be surrounded by a plurality of cord mounts 64*a*, 64*b*, and 64*c*.

Figure 4:
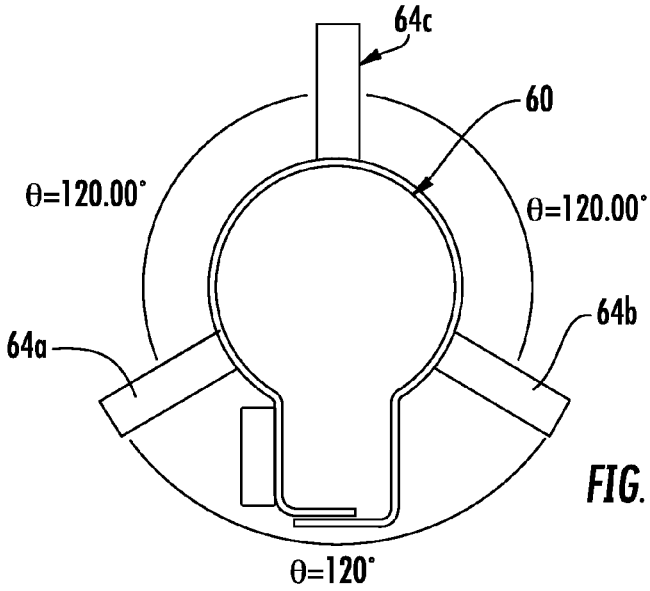
FIG. 4 is substantially a top plan view of the microphone mount embodiment of FIG. 3.

Each of the cord mounts 64*a*, 64*b*, and 64*c* may include its respective body 66*a*, 66*b*, and 66*c* and its respective pair of top cord hooks 68*a*, 68*b*, and 68*c* and bottom cord hooks 69*a*, 69*b*, and 69*c* positioned at both ends of the body 66*a*, 66*b*, or 66*c* (66*c*, 68*c*, and 69*c* not shown on FIG. 3). Each of the cord hook may form a closed end loop to hold or allow a vibration dampening cord 58*a*, 58*b*, or 58*c* to be hung thereon. In alternative embodiments, each of the cord hooks may be made of a partially closed end hook such that it allows for easy mounting and dismounting of the vibration dampening cord 58*a*, 58*b*, or 58*c*. Each of the cord mounts 64*a*, 64*b*, and 64*c* may be attached to various areas of the adjustable microphone collar 60 by fasteners known in the art. In an embodiment shown in FIG. 4, the cord mounts 64*a*, 64*b*, and 64*c* may be positioned on the adjustable microphone collar 60 at a 120 degree angle relative to each other.

Figure 5:
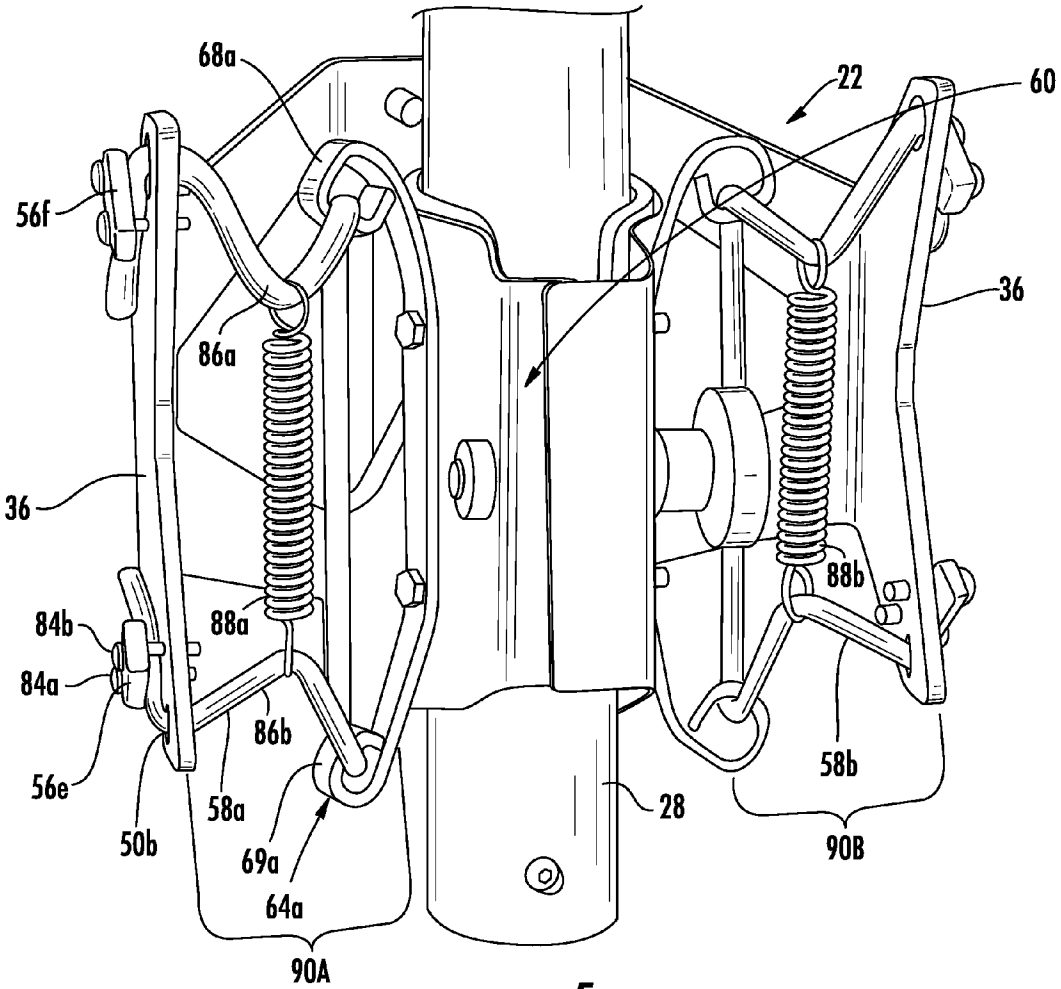
FIG. 5 is substantially a partial front view of the microphone vibration dampening device embodiment of FIG. 1, particularly showing components of the suspension and microphone clutch assemblies.

Referring now to FIG. 5, each side of the enclosing structure of the frame 36 preferably defines a plane, which collectively defines an encapsulated area, where the microphone 28 and the adjustable microphone collar 60 are preferably positioned. The microphone 28 and the adjustable microphone collar 60 are preferably held substantially inside this encapsulated area by the plurality of vibration dampening cords 58*a*, 58*b*, and 58*c* (58*c* is not shown on FIG. 5) that are adjustably attached to a side of the frame 36 and a respective cord hook. The frame 36 and the cord mounts 64*a*, 64*b*, and 64*c* that are attached to the adjustable microphone collar 60 preferably define: suspension zone 90*a* in between frame 36 and cord mount 64*a*, suspension zone 90*b* in between frame 36 and cord mount 64*b*, and suspension zone 90*c* (not shown) in between frame 36 and cord mount 64*c*.

Around suspension zone 90*a*, one end of vibration dampening cord 58*a* is preferably attached to the frame 36 via clamp 56*e* that is mounted onto mounting point 50*b*. Clamp 56*e* preferably clamps one end of the vibration dampening cord 58*a* against a surface of the frame 36 via fasteners 84*a* and 84*b*. The vibration dampening cord 58*a* preferably passes through a recess in the surface of the frame 36 to the lower cord hook 69*a* of the cord mount 64*a* thereby forming a first line. Next, the vibration dampening cord 58*c* goes through the upper cord hook 68*a* of the cord mount 64*a*. The remaining piece of the vibration dampening cord 58*c* is preferably passed through a recess defined by the surface of the frame 36 and is clamped against the frame by clamp 56*f* and its respective fasteners thereby forming a second line. A similar arrangement of the vibration dampening cord relative to the frame and the cord mount preferably exists in suspension zones 90*b* and 90*c*.

It is noted that the length of each of the vibration dampening cord 86*a* and 86*b* that spans in between the frame 36 and the cord mount 64*a* (or the first and the second lines formed by the cord) can be adjusted through clamps 56*f* and 56*e*, respectively. Thus, the clamps serve as adjustment mechanisms for the cords. Their movable attachment to the upper and lower cord hooks further adds flexibility. The flexibility of the cords provided by the clamps and the cord hooks gives the ability to adjust and customize (1) the position of the microphone relative to the microphone mount and (2) the amount of support to the microphone while at the same time dampening the vibrations transmitted to the microphone. The vibration dampening cords 86*a* and 86*b* that span in between the frame 36 and the cord mount 64*a*, or the first and the second lines, are preferably connected by a damper 88*a* that is positioned preferably approximately equidistant between the two cords 86*a* and 86*b* and that provides tension and support.

Figure 6:
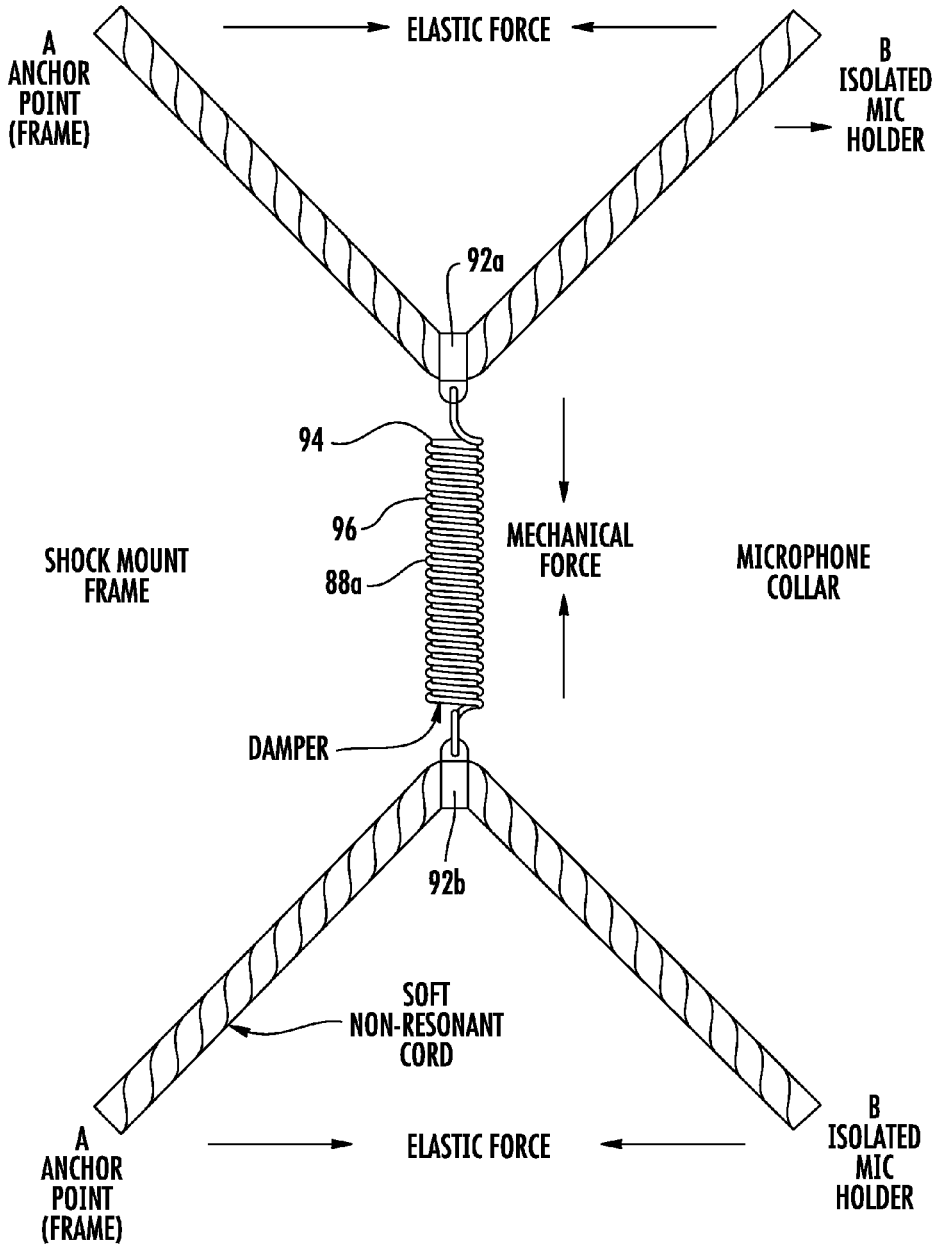
FIG. 6 is substantially a schematic view of some of the components of an embodiment of a suspension assembly of the present invention.

Referring now to FIG. 6, each of the dampers 88*a*, 88*b*, or 88*c* (88*b* and 88*c* not shown in FIG. 6) may be fixed into position along the cord with damper clamps 92*a* and 92*b* at the opposite ends of the damper 88*a*. Each damper 88*a*, 88*b*, or 88*c* preferably includes a biasing device 96, such as a mechanical spring, and a vibration dampening material 94 inserted in the hollow body of the biasing device, such as cotton, Dacron, fluff, or the vibration dampening or absorbent cord material described above. The biasing device 96 provides the tension that may be needed to support the microphone while the vibration dampening material 94 in the biasing device may absorb the vibration that is transmitted to the biasing device and consequently to the microphone.

It can now be realized that certain embodiments of the present invention cleverly combines components that when arranged in a specific configuration, function as both an elastic component and a vibration dampening or absorbent component. The interaction and cooperation of certain components eliminate the use of components that wear out over time while providing superior isolation of the microphone from vibrations. Certain embodiments of the present invention provide the ability to find the appropriate balance between the ability to support the microphone and the ability to minimize vibration. Certain embodiments provide superior ability in decoupling a microphone from a microphone stand thereby substantially eliminating low-frequency vibrations and noise that may get introduced into the microphone.

Although the description above contains many specifications, these should not be construed as limiting the scope of the invention but as merely providing illustrations of some of the presently preferred embodiments of this invention. For example, the shapes and functionality of the frames may be varied to suit a wide variety of microphone configurations and microphone stand types. The gripping mechanism for the microphone or the microphone collar can be as varied as well. For instance, an alternate version may utilize a spring loaded butterfly type clip. The adjustable clamps can be eliminated and substituted with fixed mounting points for a design where the desired suspension tension is predetermined. The embodiment described above utilizes three dampers, however more or fewer could also be used for different design requirements. The devices of the present invention may be applied to other devices besides the microphone that require acoustic isolation or low frequency mechanical isolation, such as machinery. The damper may or may not include a dampening material inside the biasing device. The invention is capable of other embodiments and of being practiced and carried out in various ways. The invention is not limited in its application to the details of the construction and to the arrangement of the components set forth in the above description or as illustrated in the drawings.

What is claimed is:

1. A device for isolating a microphone from vibrations, the device comprising:

a. a frame adapted to at least partially surround a microphone, the frame comprising a plurality of mounting points;

b. a microphone mount adapted to hold a microphone;

c. a suspension assembly adapted to connect the frame to the microphone mount, the suspension assembly comprising:

i. a cord adapted to be connected to the frame and the microphone mount;

ii. an adjustable means for adjustably fastening the cord to one of the plurality of mounting points; and iii. a damper comprising of a biasing device and a vibration absorbent material inserted in the biasing device, the damper connected to the cord and adapted to provide elasticity to the suspension assembly.

2. The device of claim 1, wherein the frame defines a plurality of surfaces, the plurality of surfaces laying on a plane that is different from each other, the plurality of surfaces being adapted to substantially surround the microphone mount.

3. The device of claim 1, wherein the microphone mount comprises:

a. a microphone collar adapted to grip the microphone; and b. a microphone collar insert adapted to be positioned in between the microphone collar and the microphone, the microphone collar insert comprising a vibration absorbent material.

4. The device of claim 1, wherein the microphone mount comprises a. microphone collar adapted to grip the microphone, the microphone collar comprising:

a. overlapping portions adapted to move towards and away from each other; and b. an adjustment means for moving the overlapping portions, wherein moving the overlapping portions towards each other tightens the grip on the microphone and moving the overlapping portions away from each other loosens the grip on the microphone.

5. The device of claim 1, further comprising a hanging means for hanging the cord to the microphone mount, wherein at least one end of the cord is adapted to be connected to one of the mounting points and a portion of the non-elastic cord is attached to the hanging means.

6. The device of claim 1, wherein the cord is a non-elastic rope.

7. A device for isolating a microphone from vibrations, the device comprising:

a. a frame comprising a plurality of surfaces, the plurality of surfaces laying on a plane that is different from each other and defining at least one mounting point;

b. at least one non-resonant cord attached to the mounting point of the frame, the non-resonant cord adapted to support a microphone and absorb vibration;

c. a microphone mount connected to the frame and the non-resonant cord, the microphone mount adapted to hold the microphone, wherein the non-resonant cord forms at least two lines between the frame and the microphone mount; and d. a biasing device positioned in between the two lines.

8. The device of claim 7, further comprising:

a. a biasing device connected to the non-resonant cord, the biasing device adapted to provide tension to the non-resonant cord, the biasing device comprising a hollow interior; and b. a vibration dampening material positioned inside the hollow interior of the biasing device.

9. The device of claim 7, further comprising a microphone mount connected to the frame and the non-resonant cord, the microphone mount adapted to hold the microphone.

10. The device of claim 9, wherein the microphone mount comprises a microphone collar adapted to grip the microphone, the microphone collar comprising a vibration absorbing insert adapted to contact the microphone.

11. The device of claim 7, wherein the frame is a unibody frame.

12. The device of claim 7, further comprising a cord adjustment mechanism, the cord adjustment mechanism comprising a clamp adapted to adjustably secure the cord to the mounting point.

13. A method of dampening vibrations transmitted to a microphone connected to a microphone stand, the method comprising:

c. securing the microphone to a microphone mount;

d. providing a cord;

e. providing a frame, the frame comprising a plurality of mounting points;

f. connecting the cord to the microphone mount and a first mounting point of the frame, the cord forming a first line;

g. connecting the cord to the microphone mount and a second mounting point of the frame, the cord forming a second line; and h. attaching a biasing device to the first and the second line, the biasing device adapted to provide tension to the cord.

14. The method of claim 13, wherein the cord is non-resonant.

15. The method of claim 13, wherein the cord is non-elastic.

16. The method of claim 13, further comprising:

i. providing a vibration dampening material, j. attaching the vibration dampening material to the biasing device.

17. The method of claim 13, further comprising adjustably securing the cord to the first mounting point.

18. The method of claim 13, further comprising positioning a vibration dampening material in between the microphone and the microphone mount.

* * * * *